US006085750A

United States Patent [19]

Majkutewicz

[11] Patent Number: 6,085,750

[45] Date of Patent: Jul. 11, 2000

[54] ANTI-CHAFING DEVICE

[76] Inventor: Ted Majkutewicz, 12 Carolyn Court, Guelph, Ontario, Canada, N1H 7N5

[21] Appl. No.: 08/583,544

[22] Filed: Jan. 5, 1996

Related U.S. Application Data

[63] Continuation of application No. 08/193,576, Feb. 8, 1994, abandoned.

[51] Int. Cl.[7] ..... A61F 5/37

[52] U.S. Cl. ..... 128/846; 128/889

[58] Field of Search ..... 128/845, 846, 128/847–856; 602/5, 13, 41, 47, 61, 62, 63; 5/636–645

[56] References Cited

U.S. PATENT DOCUMENTS

| | | | |
|---|---|---|---|
| 3,610,235 | 10/1971 | Vagacs | 602/13 |
| 4,885,811 | 12/1989 | Hayes | 602/13 |
| 5,318,505 | 6/1994 | Sou | 602/19 |
| 5,489,259 | 2/1996 | Jacobs | 602/13 |

*Primary Examiner*—Michael A. Brown
*Attorney, Agent, or Firm*—Eugene J. A. Gierczak

[57] ABSTRACT

This invention relates to a chafing device for obese individuals having a plurality of tubular body portions with air holes therethrough; a plurality of webbed portions connecting said plurality of tubular body portions, respectively, and fasteners for fastening the shield between rubbing parts of the individuals so as to minimize chafing between the rubbing parts and permit passage of air through the air holes.

8 Claims, 3 Drawing Sheets

ANTI-CHAFING DEVICE

This is a continuation of application Ser. No. 08/193,576, filed Feb. 8, 1994, now abandoned.

FIELD OF INVENTION

This invention relates to a device to minimize chafing and particularly relates to chafing shields for obese individuals

BACKGROUND OF THE INVENTION

It is not unusual for individuals to experience discomfort when rubbing or chafing occurs between the arm and side of the body in the armpit area as well as heavy inner thighs of both legs in the crotch. Such discomfort or irritation may be enhanced at higher temperatures in hot climates and particularly for obese individuals.

Moreover, the greater the degree of obesity the more likelihood there is that air will not freely pass particularly in the armpit and crotch areas, resulting in the accumulation of perspiration and body odours.

There have been some attempts in the prior art to minimize chafing between adjacent rubbing parts. For example, U.S. Pat. No. 2,429,767 teaches a chafe-eliminator member which is cut from a sheet of fabric to form a triangular main body portion having the apex outermost with a substantially horizontal base lowermost.

Moreover, U.S. Pat. No. 2,305,736 relates to an invention which aims to provide an improved crotch piece cut and shaped from underwear fabric adapted to be removably attached to a girdle or light body garment and having the combined function of converting the girdle or garment into a panty girdle and providing the wearer with an anti-chafe garment.

Furthermore, U.S. Pat. No. 4,999,854 relates to a panty hose garment having panels which prevent the skin of the wearer from coming through the knitted fabric and shields the skin of each inner thigh of the wearer from rubbing against the knitted leg portion of the other leg of the garment or against the skin of the other thigh of the wearer.

Finally, U.S. Pat. No. 1,605,323 relates to an abdominal supporter.

These and other prior art devices present relatively complicated structures.

It is an object of this invention to provide an improved anti-chafing device for individuals.

It is a particular object of this invention to provide a chafing shield for obese individuals.

It is an aspect of the invention to provide a chafing shield for obese individuals comprising:

a plurality of tubular body portions curved along the length thereof so as to present crescent shaped tubular body portions, each said crescent shaped tubular body portion defining a convex circumferential edge and a concave circumferential edge said tubular body portions disposed circumferentially adjacent one another, with said convex circumferential edge of said tubular body portions facing said concave circumferential edge of said adjacent tubular body portion said tubular body portions having air holes therethrough; a plurality of webbed portions connecting said plurality of tubular body portions, respectively; and means for fastening said chafing shield between rubbing parts of said individual so as to minimize chafing between said parts and permit passage of air through said air holes.

Another aspect of the invention relates to a device to minimize chafing comprising a deformable cushion member having holes therethrough, said cushion member comprising a plurality of tubular portions curved along the length thereof so as to present crescent shaped tubular portions, said tubular portions spaced from one another and circumferentially joined by webbed portions, wherein said plurality of tubular portions have different lengths, and wherein said webbed portions are adapted to be cut so as to adjust the size of said shield for different individuals.

Yet another aspect of the invention relates to a method of minimizing chafing between rubbing parts of an individual with a deformable cushion member having a plurality of tubular portions curved along the length thereof so as to present crescent shaped tubular portions; said tubular portions having different lenghts and joined by webbed portions, comprising the steps of cutting said webbed portions so as to adjust the size of said shield for said individual; placing said shield between rubbing parts of said individual; fastening said shield to said individual by attaching fastening means to said shield.

DESCRIPTION OF THE DRAWINGS

These and other objects and features shall now be described in relation to the following drawings.

DESCRIPTION OF THE INVENTION

Like parts shall be given like numbers throughout the figures.

Figure 2:
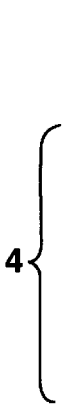
FIG. 2 is a side elevational view of said chafing shield of FIG. 1.
Figure 1:
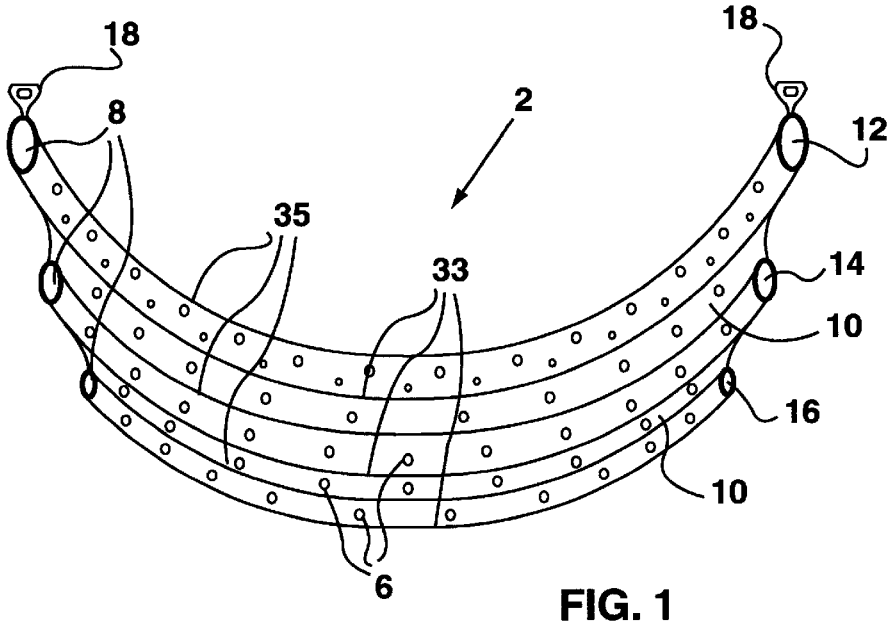
FIG. 1 is a top plan view of one embodiment of said chafing shield.
Figure 5:
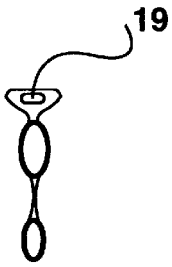
FIG. 5 is a side elevational view of FIG. 4.
Figure 3:
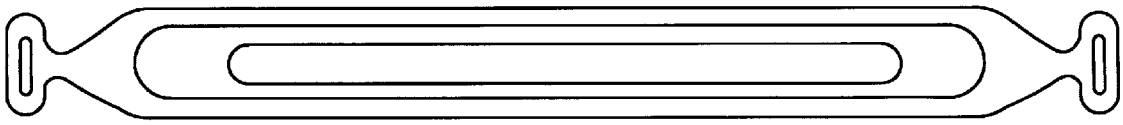
FIG. 3 is a bottom view of FIG. 1.
Figure 6:
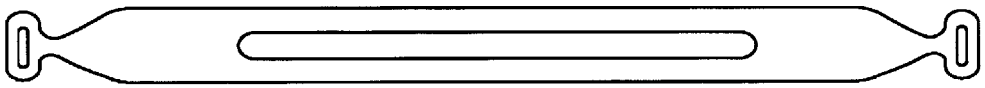
FIG. 6 is a bottom view of FIG. 4.

FIGS. 1, 2 and 3 show the device 2 which is a chafing shield for obese individuals. The device or chafing shield 2 comprises a cushion member 4 having holes 6 therethrough.

In particular the cushion members 4 is comprised of plastic which is soft and deformable. More particularly the cushion members 4 comprise of the plurality of tubular portions 8 which are circumferentially connected to one another in side-by-side relationship as best seen in FIG. 1. The tubular portions 8 are connected to one another by webbed portions as best seen in FIG. 2. The tubular portions 8 are hollow as shown in the figures or may comprise spongy material.

The tubular portions 8 are also curved so as to assist in placement of the device 2 in a manner to be more fully described herein. Moreover, the tubular portions 8 may have different diameters 12, 14 and 16.

The webbed portions 10 are adapted to be cut by scissors or the like so as to accommodate different sizes of individuals.

Figure 4:
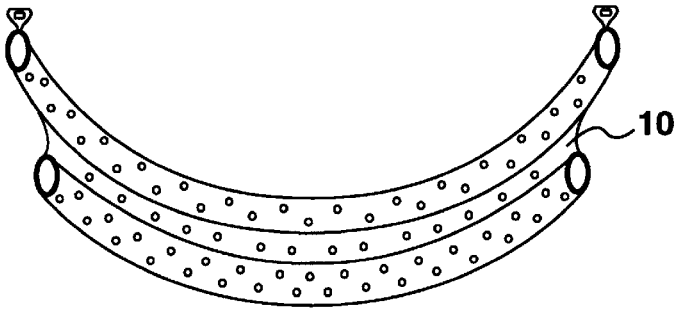
FIG. 4 is a top plan view of a second embodiment of the invention.
Figure 8:
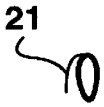
FIG. 8 is a side elevational view of FIG. 7.

The device 2 may also include a fastening web 18 which has a fastening hole 19 which can have fastened thereto fastening means such as string or safety pin or the like. The embodiment shown in FIG. 1 is adapted to fasten around the upper thigh of an individual so that the anti-chafing device 2 may be placed in the crotch of an individual. The embodiment of FIG. 4 is smaller in size than the embodiment shown in FIG. 1 and accordingly may be adapted to be placed around the upper arm of an individual so that the anti-chafing device 2 may be placed between the inner arm of the individual and the upper side body under the arm-pit. If a string is used to fasten the device 2 the string is adapted to be tied to hole 19 and then strung around the upper arm of an individual so that the anti-chafing device 2 may be placed between the arm and body. The string may comprise of stretchable elastic material. Alternatively, it is possible to fasten the chafing shield 2 to the undergarment of an individual by means of sewing the device 2 to the undergarment (not shown) whereby the sewing will take place between the fastening web 18 and the undergarment (not shown) or by means of a safety pin which engages the hole 19 and undergarment.

Since there are different sizes of individuals the chafing shield 2 may be adjusted to accommodate the different sizes of individuals by cutting any excess unnecessary material from the chafing shield 2. In particular, an individual may cut along the webs 10 so as to eliminate any unnecessary tubular sections 8 so as to accommodate different sizes of individuals.

The tubular sections 8 also have a plurality of air holes therethrough so as to permit passage of air through the chafing shield 2. The tubular sections may comprise of sponge material throughout the tubular section or be hollow as shown in the figures to enhance air flow. The hollow tubular portions are deformable under pressure from weight by the individual.

The tubular sections 8 are curved or crescent shaped so as to appropriately fit under the curved portion of the armpit or the crotch area. In particular the crescent shaped body portions define a convex circumferential edge 33 and concave circumferential edge 35. The tubular body portions 8 are disposed circumferentially adjacent one another with the convex circumferential edge 35 of the tubular body portion 8 facing the concave circumferential edge 35 of the adjacent tubular body portion 8. The tubular sections 8 appropriately fit under the curved portion of the armpit or crotch area.

Figure 7:
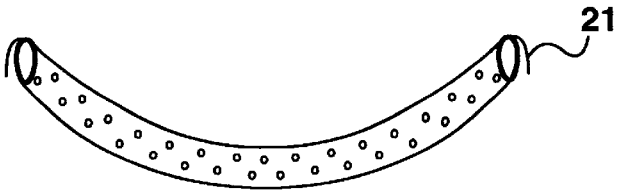
FIG. 7 is a top plan view of a third embodiment of the invention.
Figure 9:
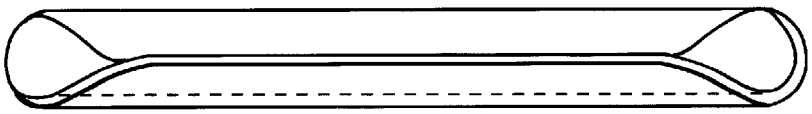
FIG. 9 is a bottom view of FIG. 7.
Figure 10:
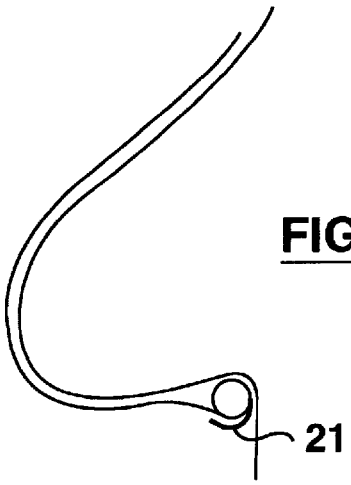
FIG. 10 is a side elevational view of the embodiment of FIG. 5 in place.

The embodiment shown in FIG. 7 may be adapted to be worn under a breast of an individual as shown in FIG. 9 whereby the fastening means comprises a clip 21 which will clip to the undergarment such as to the peripheral edge of a bra as best seen in FIG. 7.

Accordingly, the operation and use of the chafing shield 2 shall now be described. An individual, particularly an obese individual, may adjust the size of the chafing shield 2 by cutting along appropriate webs 10 so as to accommodate the size of the individual. Thereafter the chafing shield 2 is fastened into place by either placing the arm or leg into the opening 22 and fastening the device 2 over the arm or leg, respectively, by means of the fastening 20. Alternatively, the chafing shield 2 may be fastened to the undergarment (not shown). Thereafter during walking the rubbing parts of the inner thighs or the inner arm and side of the body will be spaced apart by the chafing shield 2 thereby minimizing chafing. Moreover, any build up of perspiration will tend to be minimized since air will be permitted to pass through the air holes 6.

Figure 11:
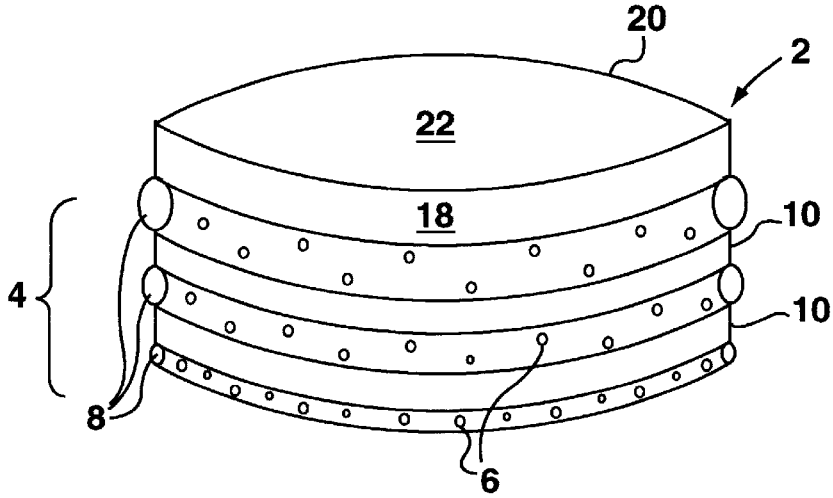
FIG. 11 is a top plan view of a fourth embodiment of the invention.
Figure 12:
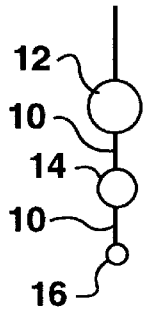
FIG. 12 is a side elevational view of FIG. 11.

FIGS. 11 and 12 illustrate the device 2 with a larger web 18 and string 20 which has an arm or leg entry 22.

Figure 13:
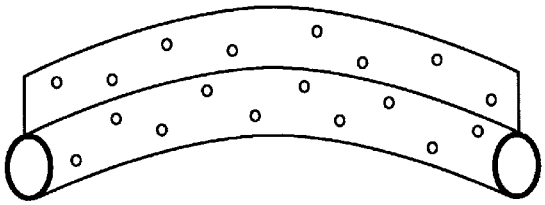
FIG. 13 is a top plan view of a fifth embodiment of the invention.
Figure 14:
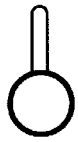
FIG. 14 is a side elevational view of FIG. 13.

FIGS. 13 and 14 show another variation of the invention. The web 18 may also have holes 6.

Although the invention has been described in relation to obese individual the anti-chafing device 2 may also be used by other individuals where it is necessary to minimize chafing between rubbing parts of a body as, for example, where an injury has taken place in such area or the like.

Although the preferred embodiment as well as the operation and the use have been specifically described, it should be understood the variations in the preferred embodiment could be achieved by a person skilled in the art without departing from the spirit of the invention.

The embodiments of the invention in which an exclusive property or privilege is claimed are defined as follows:

I claim:

1. A chafing shield for obese individuals comprising:

(a) a plurality of tubular body portions disposed circumferentially adjacent one another, said tubular body portions having air holes therethrough;

(b) a plurality of webbed portions connecting said plurality of tubular body portions, respectively; and (c) means for fastening said chafing shield between rubbing parts of said individual so as to minimize chafing between said parts and permit passage of air through said air holes.

2. A chafing shield as claimed in claim 1 wherein said plurality of webbed portions connect said plurality of tubular portions between said convex circumferential edge and said concave circumferential edge.

3. A chafing shield as claimed in claim 2 wherein said webbed portions have holes.

4. A chafing shield as claimed in claim 3 wherein said webbed portions are adapted to be cut so as to adjust the size of said shield for different individuals.

5. A chafing shield as claimed in claim 4 wherein said shield is comprised of plastic.

6. A chafing shield as claimed in claim 5 wherein said plurality of tubular body portions have different lenghts, and wherein said webbed portions are adapted to be cut so as to adjust the size of said shield for different individuals.

7. A device to minimize chafing comprising a deformable cushion member having holes therethrough, said cushion member comprising a plurality of tubular portions curved along the length thereof so as to present crescent shaped tubular portions, said tubular portions spaced from one another and circumferentially jointed by webbed portions, wherein said plurality of tubular portions have different lengths, and wherein said webbed portions are adapted to be cut so as to adjust the size of said shield for different individuals.

8. A method of minimizing chafing between rubbing parts of an individual with a deformable cushion member having a plurality of tubular portions curved along the length thereof so as to present crescent shaped tubular portions; said tubular portions having different lenghts and joined by webbed portions, comprising the steps of:

(a) cutting said webbed portions so as to adjust the size of said shield for said individual;

(b) placing said shield between rubbing parts of said individual;

(c) fastening said shield to said individual by attaching fastening means to said shield.

* * * * *